US007643614B2

(12) United States Patent
Hebert et al.

(10) Patent No.: US 7,643,614 B2
(45) Date of Patent: Jan. 5, 2010

(54) METHOD AND APPARATUS FOR INCREASING HEAT RADIATION FROM AN X-RAY TUBE TARGET SHAFT

(75) Inventors: Michael Hebert, Muskego, WI (US); Gregory Alan Steinlage, Hartland, WI (US); Thomas C. Tiearney, Jr., Waukesha, WI (US)

(73) Assignee: General Electric Company, Schenectady, NY ( * ) Notice: Subject to any disclaimer, the term of this patent is extended or adjusted under 35 U.S.C. 154(b) by 33 days.

(21) Appl. No.: 11/860,657

(22) Filed: Sep. 25, 2007

(65) Prior Publication Data

US 2009/0080615 A1 Mar. 26, 2009

(51) Int. Cl.
*H01J 35/00* (2006.01)

(52) U.S. Cl. ..... 378/129; 378/144

(58) Field of Classification Search ..... 378/129, 378/143, 144

See application file for complete search history.

(56) References Cited

U.S. PATENT DOCUMENTS

| | | | | |
|---|---|---|---|---|
| 4,870,672 | A | 9/1989 | Lindberg | 378/129 |
| 5,553,114 | A | 9/1996 | Siemers et al. | 378/129 |
| 6,144,720 | A | 11/2000 | DeCou et al. | 378/131 |
| 6,456,692 | B1 * | 9/2002 | Smith | 378/129 |
| 6,553,097 | B2 * | 4/2003 | Hansen et al. | 378/144 |
| 6,707,883 | B1 * | 3/2004 | Tiearney et al. | 378/144 |
| 2004/0032929 | A1 * | 2/2004 | Andrews et al. | 378/119 |

* cited by examiner

*Primary Examiner*—Courtney Thomas
(74) *Attorney, Agent, or Firm*—Ziolkowski Patent Solutions Group, SC

(57) ABSTRACT

A target for generating x-rays includes a target substrate, a target shaft attached to the target substrate, and a radiation emissive coating applied to at least one of the target substrate and the target shaft, wherein a center-of-gravity of the target is positioned between a front bearing assembly and a rear bearing assembly of an x-ray tube.

29 Claims, 3 Drawing Sheets

METHOD AND APPARATUS FOR INCREASING HEAT RADIATION FROM AN X-RAY TUBE TARGET SHAFT

BACKGROUND OF THE INVENTION

The present invention relates generally to x-ray tubes and, more particularly, to a high emissive coating on a target shaft of an x-ray tube.

X-ray systems typically include an x-ray tube, a detector, and a bearing assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner.

X-ray tubes include a rotating anode structure for the purpose of distributing the heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator. An x-ray tube cathode provides a focused electron beam that is accelerated across a cathode-to-anode vacuum gap and produces x-rays upon impact with the anode. Because of the high temperatures generated when the electron beam strikes the target, it is necessary to rotate the anode assembly at high rotational speed.

Newer generation x-ray tubes have increasing demands for providing higher peak power, thus higher average power as well. Higher peak power, though, results in higher peak temperatures occurring in the target assembly, particularly at the target "track," or the point of impact on the target. Thus, for increased peak power applied, there are life and reliability issues with respect to the target. Such effects may be countered to an extent by, for instance, spinning the target faster. However, doing so has implications to reliability and performance of other components within the x-ray tube such as the target and the bearing assembly. And, although spinning the target faster may reduce the peak focal track temperature, there is limited enhancement or improvement in the overall average power capability of the x-ray tube. As such, spinning faster has minimal impact on decreasing the operating temperature of the bearing assembly for a given average power.

Therefore, it would be desirable to have a method and apparatus to improve thermal performance and reliability of an x-ray tube target and bearing.

BRIEF DESCRIPTION OF THE INVENTION

The present invention provides a high emissive coating on a target shaft of an x-ray tube anode.

According to one aspect of the present invention, a target for generating x-rays includes a target substrate, a target shaft attached to the target substrate, and a radiation emissive coating applied to at least one of the target substrate and the target shaft, wherein a center-of-gravity of the target is positioned between a front bearing assembly and a rear bearing assembly of an x-ray tube.

In accordance with another aspect of the invention, a method of fabricating an x-ray target assembly includes forming a substrate, and attaching a target shaft to the substrate. The method further includes forming a radiation emissive coating on at least one of the substrate and the target shaft and positioning a center-of-gravity of the substrate between a front bearing assembly and a rear bearing assembly of an x-ray tube.

Yet another aspect of the present invention includes an imaging system having an x-ray detector and an x-ray emission source. The x-ray emission source includes a cathode, a front bearing assembly, a rear bearing assembly, and an anode having a center-of-gravity between the front bearing assembly and the rear bearing assembly. The anode includes a target base material, a shaft attached to the target base material, and a radiation emissive coating attached to at least one of the target base material and the shaft.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
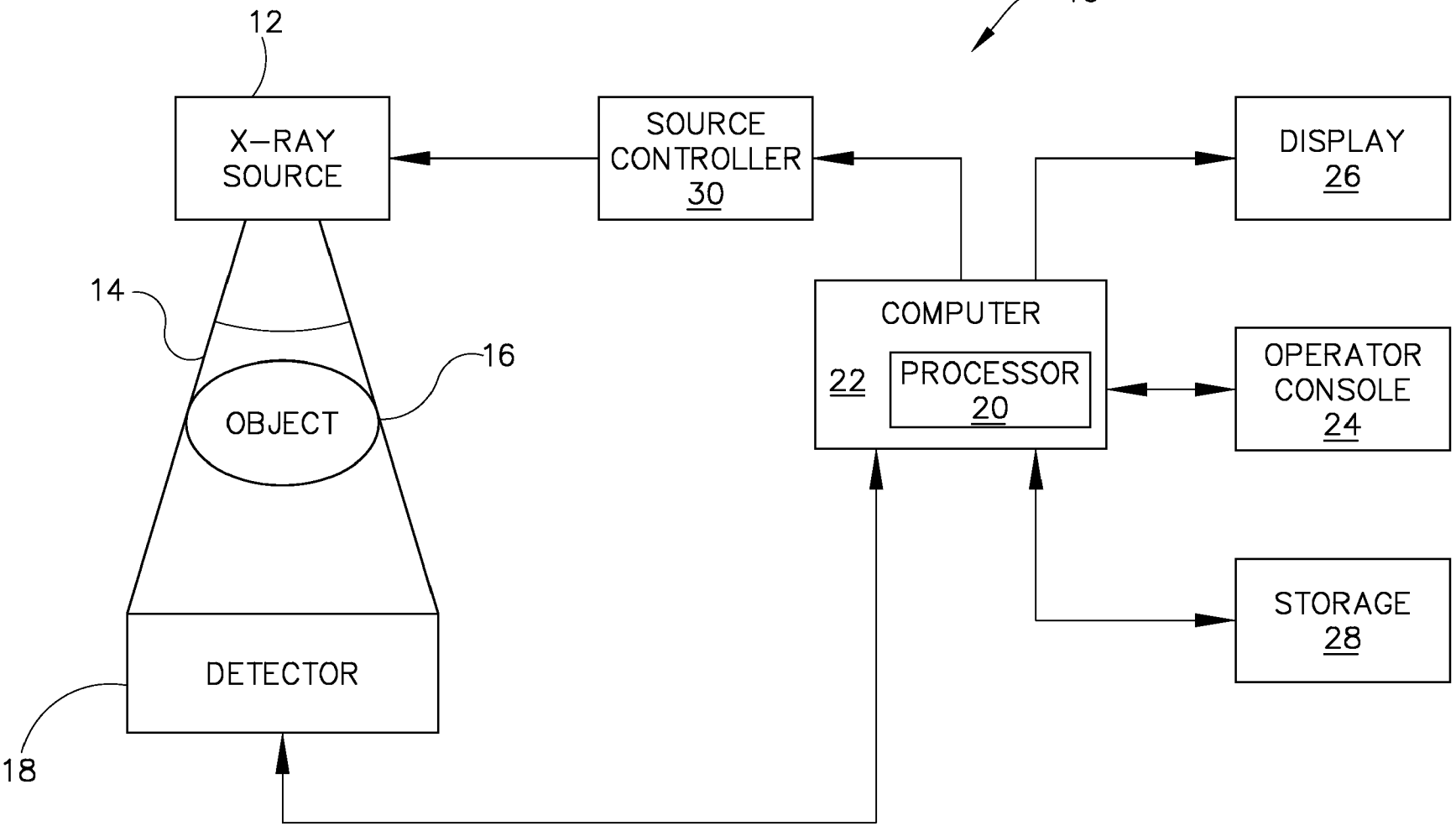
FIG. 1 is a block diagram of an imaging system that can benefit from incorporation of an embodiment of the present invention.

FIG. 1 is a block diagram of an embodiment of an imaging system 10 designed both to acquire original image data and to process the image data for display and/or analysis in accordance with the present invention. It will be appreciated by those skilled in the art that the present invention is applicable to numerous medical imaging systems implementing an x-ray tube, such as x-ray or mammography systems. Other imaging systems such as computed tomography systems and digital radiography systems, which acquire image three dimensional data for a volume, also benefit from the present invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the analog electrical signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

Moreover, the present invention will be described with respect to use in an x-ray tube. However, one skilled in the art will further appreciate that the present invention is equally applicable for other systems that require operation of a target used for the production of x-rays wherein high peak temperatures are driven by peak power requirements.

Figure 2:
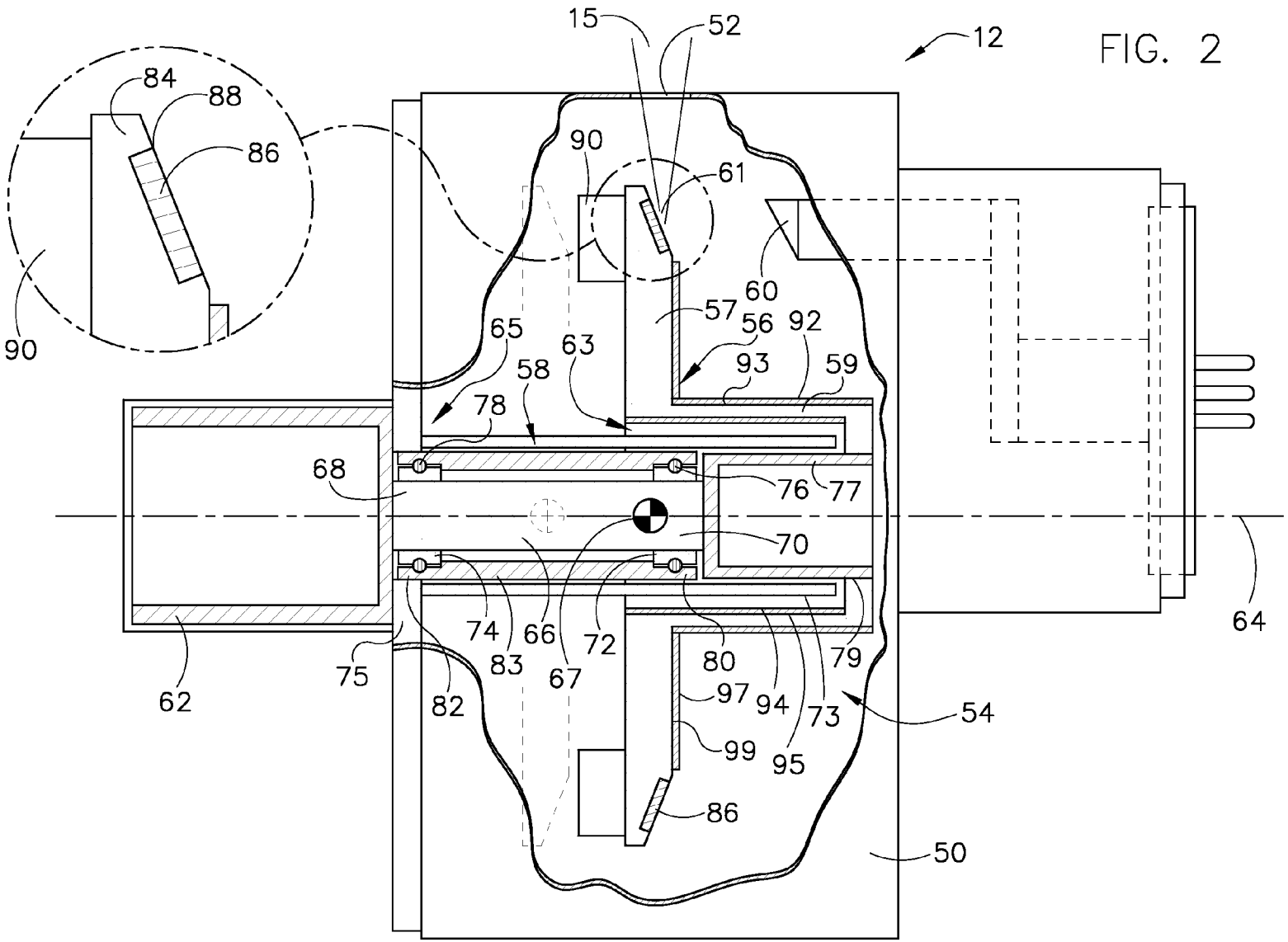
FIG. 2 is a cross-sectional view of an x-ray tube according to an embodiment of the present invention and useable with the system illustrated in FIG. 1.

FIG. 2 illustrates a cross-sectional view of an x-ray tube 12 incorporating an embodiment of the present invention. The x-ray tube 12 includes a frame, or casing 50 having a radiation emission passage 52 formed therein. The casing 50 encloses a vacuum 54 and houses an anode 56, a bearing cartridge 58, a cathode 60, and a rotor 62. The anode 56 includes a target 57 having a target shaft 59 attached thereto. X-rays 15 are produced when high-speed electrons are decelerated when directed from the cathode 60 to the target 57 via a potential difference therebetween of, for example, 60 thousand volts or more in the case of CT applications. The electrons impact a target track material 86 at focal point 61 and x-rays 15 emit therefrom. The x-rays 15 emit through the radiation emission passage 52 toward a detector array, such as detector 18 of FIG. 1. To avoid overheating the target track material 86 from the electrons, the anode 56 is rotated at a high rate of speed about a centerline 64 at, for example, 90-250 Hz.

The bearing cartridge 58 includes a front bearing assembly 63 and a rear bearing assembly 65. The bearing cartridge 58 further includes a center shaft 66 attached to the rotor 62 at a first end 68 of center shaft 66 and a bearing hub 77 attached at a second end 70 of center shaft 66. The front bearing assembly 63 includes a front inner race 72, a front outer race 80, and a plurality of front balls 76 that rollingly engage the front races 72, 80. The rear bearing assembly 65 includes a rear inner race 74, a rear outer race 82, and a plurality of rear balls 78 that rollingly engage the rear races 74, 82. Bearing cartridge 58 includes a stem 83 which is supported by the x-ray tube 12. A stator (not shown) is positioned radially external to and drives the rotor 62, which rotationally drives anode 56. The target shaft 59 is attached to the bearing hub 77 at joint 79. One skilled in the art would recognize that target shaft 59 may be attached to the bearing hub 77 with other attachment means, such as a bolted joint, a braze joint, a weld joint, and the like. In one embodiment a receptor 73 is positioned to surround the stem 83 and is attached to the x-ray tube 12 at the back plate 75. The receptor 73 extents into a gap formed between the target shaft 59 and the bearing hub 77.

Referring still to FIG. 2, the target 57 includes a target substrate 84, having target track material 86 attached thereto. The target track material 86 typically includes tungsten or an alloy of tungsten, and the target substrate 84 typically includes molybdenum or an alloy of molybdenum. A heat storage medium 90, such as graphite, may be used to sink and/or dissipate heat built-up near the focal point 61. One skilled in the art will recognize that the target track material 86 and the target substrate 84 may comprise the same material, which is known in the art as an all metal target.

The anode 56 has a re-entrant target design that serves to position the mass or center-of-gravity 67, of target 57 at a position between the front bearing assembly 63 and the rear bearing assembly 65 and substantially along centerline 64, about which center shaft 66 rotates. Additionally, both target shaft 59 and bearing hub 77 serve to increase a conduction path length between target 57 and bearing cartridge 58 such that a reduction in the peak operating temperature of front inner race 72, front balls 76, and front outer race 80 may be realized as compared to a direct connection of target 57 to second end 70 of center shaft 66. In one embodiment, as illustrated in phantom in FIG. 2, the center-of-gravity 67 of the target 57 is positioned equidistant between the front bearing assembly 63 and the rear bearing assembly 65. As such, the mechanical load of the target is positioned between the two bearing assemblies, thus causing the two bearing assemblies 63, 65 to wear at approximately equal rates. One skilled in the art would recognize that the positioning of target 57 in a re-entrant target design as illustrated also results in a combined center-of-gravity of target 57, target shaft 59, bearing hub 77, center shaft 66, and rotor 62 positioned between the front bearing assembly 63 and the rear bearing assembly 65. The distance of re-entrance of target 57 may be designed such that the combined center-of-gravity may be positioned equidistant between front bearing assembly 63 and rear bearing assembly 65 to cause two bearing assemblies 63, 65 to wear at approximately equal rates.

In operation, as electrons impact focal point 61 and produce x-rays, heat generated therein causes the target 57 to increase in temperature, thus causing the heat to transfer via radiation heat transfer to surrounding components such as, and primarily, casing 50. Heat generated in target 57 also transfers conductively through target shaft 59 and bearing hub 77 to bearing cartridge 58 as well, leading to an increase in temperature of bearing cartridge 58. To reduce conductive heat transfer into bearing cartridge 58 and increase the amount of radiation heat transfer to the surrounding components, an emissive coating 92 may be applied to an outer diameter or surface 93 of target shaft 59. Without an emissive coating, target shaft 59 may have an emissivity of 0.18. One skilled in the art would recognize that the emissive coating 92 may be applied by, for instance, plasma spray, chemical vapor deposition, electro-plating or physical vapor deposition, and the like, according to an embodiment of the present invention. In one embodiment the emissivity may be increased to, for instance, greater than 0.18. In one embodiment a coating having an emissivity of 0.75 is applied. An emissive coating 97, furthermore, may be applied to a substrate, or surface 99 of the target 57 transverse to the axis of rotation 64. One skilled in the art will recognize that an emissive coating may be applied to an outer circumference of the target 57, or to a surface parallel to and opposite that of surface 99. With the increase in radiative emissivity on outer surface 93 or surface 99, an increase in heat transferred out of target shaft 59 via radiation will thus reduce heat transferred out of target shaft 59 via conduction, and, as a consequence, the operating temperature of the target shaft 59, the bearing hub 77, and the bearing cartridge 58 may be reduced.

In like fashion an emissive coating 94 may likewise be applied to an inner diameter or surface 95 of target shaft 59. Accordingly, the operating temperature of the target shaft 59 may likewise be reduced in temperature as compared to a surface 95 without an emissive coating. And, although the inner surface 95 of the target shaft 59 views, in part, the bearing hub 77, the target shaft 59 also views stem 83. Thus, an increase in the emissivity of surface 95 will likewise increase the amount of radiation heat transfer to the stem 83, thus avoiding some of the heat that would otherwise conduct down the bearing hub 77 to the front bearing assembly 63. One skilled in the art will recognize that as for a longer target shaft 59 length, more of the surface 95 would likewise be exposed to the outer surface of stem 83, thus increasing the rate of radiation heat transfer to the stem 83, thereby avoiding some heat transfer via conduction directly into the front bearing assembly 63. Furthermore, one skilled in the art would recognize that, in an embodiment that includes a receptor 73, then heat transfer from the target shaft 59 to the receptor 73 will likewise be increased for increased emissivity of target shaft 59 at surface 95.

Figure 3:
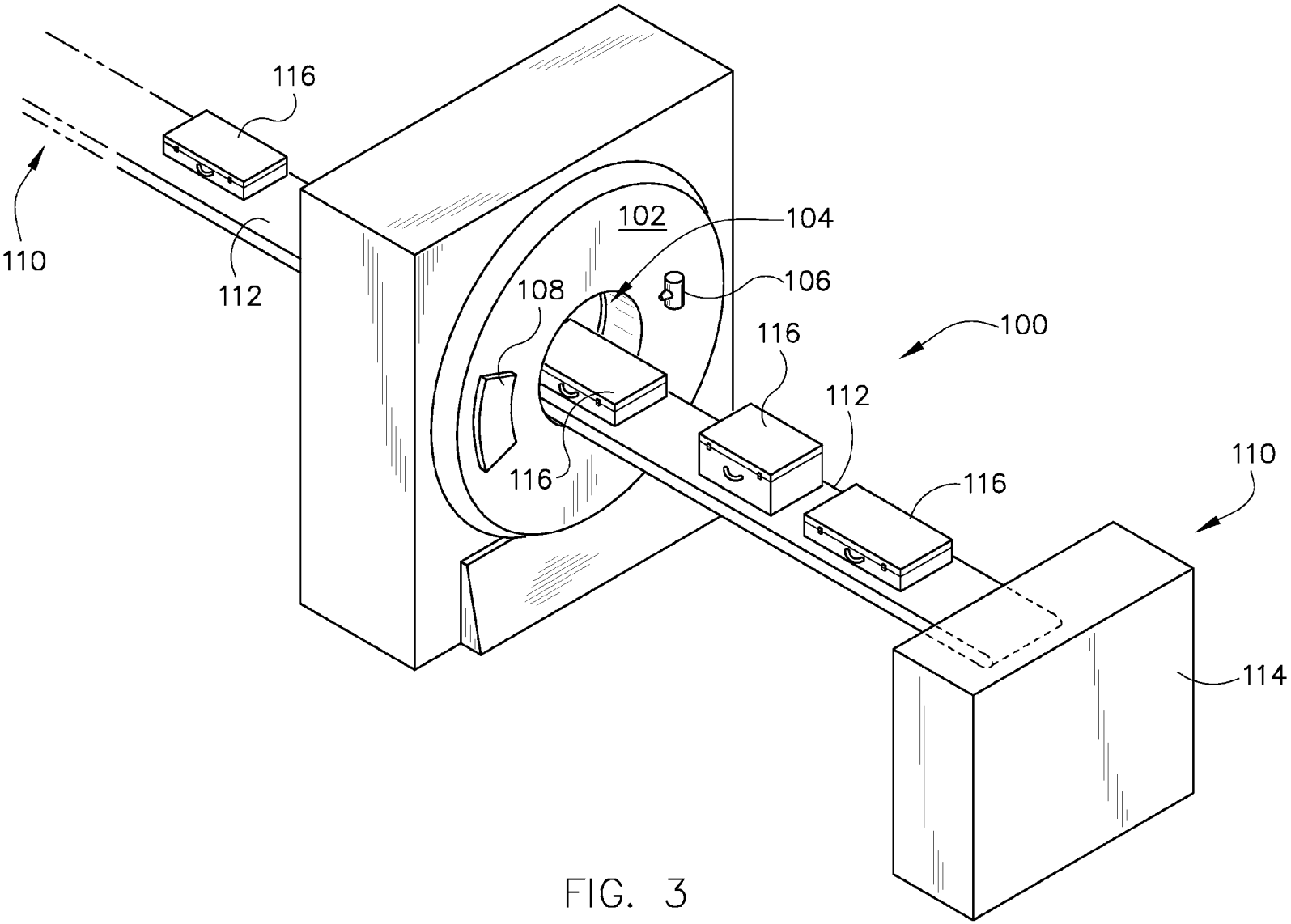
FIG. 3 is a pictorial view of a CT system for use with a non-invasive package inspection system that can benefit from incorporation of an embodiment of the present invention.

FIG. 3 is a pictorial view of a CT system for use with a non-invasive package inspection system. Package/baggage inspection system 100 includes a rotatable gantry 102 having an opening 104 therein through which packages or pieces of baggage may pass. The rotatable gantry 102 houses a high frequency electromagnetic energy source 106 as well as a detector assembly 108 having scintillator arrays comprised of scintillator cells. A conveyor system 110 is also provided and includes a conveyor belt 112 supported by structure 114 to automatically and continuously pass packages or baggage pieces 116 through opening 104 to be scanned. Objects 116 are fed through opening 104 by conveyor belt 112, imaging data is then acquired, and the conveyor belt 112 removes the packages 116 from opening 104 in a controlled and continuous manner. As a result, postal inspectors, baggage handlers, and other security personnel may non-invasively inspect the contents of packages 116 for explosives, knives, guns, contraband, etc.

According to one embodiment of the present invention, a target for generating x-rays includes a target substrate, a target shaft attached to the target substrate, and a radiation emissive coating applied to at least one of the target substrate and the target shaft, wherein a center-of-gravity of the target is positioned between a front bearing assembly and a rear bearing assembly of an x-ray tube.

In accordance with another embodiment of the invention, a method of fabricating an x-ray target assembly includes forming a substrate, and attaching a target shaft to the substrate. The method further includes forming a radiation emissive coating on at least one of the substrate and the target shaft and positioning a center-of-gravity of the substrate between a front bearing assembly and a rear bearing assembly of an x-ray tube.

Yet another embodiment of the present invention includes an imaging system having an x-ray detector and an x-ray emission source. The x-ray emission source includes a cathode, a front bearing assembly, a rear bearing assembly, and an anode having a center-of-gravity between the front bearing assembly and the rear bearing assembly. The anode includes a target base material, a shaft attached to the target base material, and a radiation emissive coating attached to at least one of the target base material and the shaft.

The present invention has been described in terms of the preferred embodiment, and it is recognized that equivalents, alternatives, and modifications, aside from those expressly stated, are possible and within the scope of the appending claims.

What is claimed is:

1. An apparatus for generating x-rays comprising:

a target substrate;

a re-entrant target shaft attached to the target substrate, the re-entrant target shaft having an inner surface and an outer surface, the inner surface positioned to face toward a center of rotation of the target;

an emissive coating applied to the target substrate and the inner surface of the target shaft; a bearing cartridge coupled to the re-entrant target shaft and configured to cause the re-entrant target shaft to rotate about the center of rotation, the bearing cartridge comprising:

a shaft;

a stem; and a bearing assembly rotatably coupling the shaft to the stem; and a receptor extending between the inner surface of the re-entrant target shaft and the stem such that a first gap is formed between the re-entrant target shaft and the receptor and such that a second gap is formed between the stem and the receptor, wherein the receptor is configured to receive a heat transfer from the inner surface of the target shaft.

2. The apparatus of claim 1 further comprising a track material attached to the target substrate.

3. The apparatus of claim 1 further comprising a heat storage medium attached to the target substrate.

4. The apparatus of claim 3 wherein the heat storage medium is graphite.

5. The apparatus of claim 1 wherein the emissive coating applied to the target substrate is applied to a face of the target substrate transverse to an axis of rotation of the target substrate.

6. The apparatus of claim 1 comprising an emissive coating applied to an outer surface of the re-entrant target shaft.

7. The apparatus of claim 1 wherein the emissive coating is one of a plasma spray coating, a chemical vapor deposition coating, an electroplate coating, and a physical vapor deposition coating.

8. The apparatus of claim 1 wherein a center of gravity of the target is positioned between a front bearing assembly and a rear bearing assembly.

9. The apparatus of claim 8 wherein the center-of-gravity of the target is positioned equidistant between the front bearing assembly and the rear bearing assembly.

10. The apparatus of claim 1 wherein the target material comprises one of molybdenum and an alloy of molybdenum.

11. The apparatus of claim 1 wherein the track material comprises one of tungsten and an alloy of tungsten.

12. The apparatus of claim 1 wherein the target is positioned within an x-ray tube and the x-ray tube is positioned within a system that comprises one of an x-ray system, a digital radiography system, a computed tomography system, and a mammography system.

13. The apparatus of claim 1 wherein the re-entrant target shaft comprises the target substrate axially positioned between a front bearing and a rear bearing, the re-entrant target shaft forming a radial gap between the re-entrant target shaft and a bearing hub.

14. An apparatus for generating x-rays comprising:

a target substrate having a face thereof transverse to an axis of rotation of the target substrate;

a target shaft attached to the target substrate, the target shaft having an outer surface and an inner surface;

an emissive coating applied to the face of the target substrate and to the inner surface of the target shaft;

a bearing cartridge coupled to the target shaft and configured to cause the target shaft to rotate about the axis of rotation, the bearing cartridge comprising:

a center shaft;

a stem; and a pair of bearing assemblies rotatably coupling the center shaft to the stem; and a receptor extending between the target shaft and the stem such that a first gap is formed between the stem and the receptor, wherein the receptor is configured to receive a transfer of heat from the inner surface of the target shaft.

15. A method of fabricating an x-ray tube target assembly comprising:

forming a substrate;

attaching a target shaft to the substrate;

positioning the substrate equidistant between a front bearing and a rear bearing; and forming an emissive coating on the substrate and the target shaft.

16. The method of claim 15 further comprising forming a track material on the substrate.

17. The method of claim 15 wherein the emissive coating is formed by one of plasma spray, chemical vapor deposition, and physical vapor deposition.

18. The method of claim 15 wherein the emissive coating is formed on a face of the substrate transverse to an axis of rotation of the substrate.

19. The method of claim 15 wherein the emissive coating is formed on an outer surface of the target shaft and on an inner surface of the target shaft.

20. The method of claim 15 further comprising attaching the target shaft to a hub of a bearing shaft, wherein the bearing shaft passes through at least one of a front bearing assembly and a rear bearing assembly.

21. An imaging system comprising:

an x-ray detector; and an x-ray emission source having:

a bearing cartridge comprising:

a center shaft;

a stem; and a bearing assembly rotatably coupling the shaft to the stem;

a cathode;

an anode, the anode comprising:

a target base material;

a shaft attached to the target base material, the shaft having an inner surface and an outer surface; and an emissive coating attached to the target base material and both the inner surface of the shaft and the outer surface of the shaft; and a receptor positioned between the stem of the bearing cartridge and the inner surface of the shaft such that a space is formed between the receptor and the stem.

22. The method of claim 20 further comprising positioning a receptor between the target shaft and a stem of the bearing shaft such that a first gap is formed between the stem and the receptor.

23. The system of claim 21 further comprising a track material attached to the target base material.

24. The system of claim 21 further comprising a hub attached to the center shaft of the bearing cartridge and to the shaft attached to the target base material, wherein the receptor extends between the hub and the shaft attached to the target base material.

25. The system of claim 21 wherein the system comprises one of an x-ray system, a digital radiography system, a computed tomography system, and a mammography system.

26. The system of claim 21 wherein the emissive coating is attached to an outer surface of the target base material.

27. The system of claim 21 wherein the emissive coating is attached to an outer surface of the shaft.

28. The system of claim 21 wherein the emissive coating is attached to an inner surface of the shaft.

29. The system of claim 21 wherein the emissive coating is attached to an outer surface of the shaft and an inner surface of the shaft.

* * * * *